US007204005B2

(12) United States Patent
Fukada et al.

(10) Patent No.: US 7,204,005 B2
(45) Date of Patent: Apr. 17, 2007

(54) MANUFACTURING METHOD OF ENDLESS METAL BELT AND MANUFACTURING APPARATUS OF ENDLESS METAL BELT

(75) Inventors: Ryuji Fukada, Yokohama (JP); Mitsutaka Akutsu, Zama (JP); Masayuki Suzuki, Atsugi (JP); Masaaki Yoshitome, Sagamihara (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 0 days.

(21) Appl. No.: 10/644,087

(22) Filed: Aug. 20, 2003

(65) Prior Publication Data

US 2004/0103708 A1 Jun. 3, 2004

(30) Foreign Application Priority Data

Aug. 30, 2002 (JP) ..... 2002-255941
Sep. 12, 2002 (JP) ..... 2002-266922

(51) Int. Cl.
*B23Q 17/00* (2006.01)
*B21D 15/00* (2006.01)

(52) U.S. Cl. ..... 29/407.05; 29/407.01; 72/111; 72/110; 72/205; 72/378; 72/113; 148/589; 148/226

(58) Field of Classification Search ..... 29/417, 29/407.05, 407.01; 148/589, 534, 226, 228, 148/230, 231; 72/110, 111, 365.2, 378, 8.3, 72/8.4, 107, 113, 183, 205
See application file for complete search history.

(56) References Cited

U.S. PATENT DOCUMENTS 3,892,344 A * 7/1975 Corse ..... 226/44
4,176,538 A * 12/1979 Kymmell et al. ..... 72/110
4,688,407 A * 8/1987 Schroder ..... 72/111
4,757,701 A * 7/1988 Hamada ..... 72/110
4,796,449 A * 1/1989 Berne ..... 72/8.3
5,640,868 A * 6/1997 Lauener ..... 72/110
5,660,650 A * 8/1997 Okita et al. ..... 148/589
6,318,140 B1 * 11/2001 Yamagishi et al. ..... 72/110
6,379,473 B1 * 4/2002 Imai et al. ..... 148/231
6,550,122 B1 * 4/2003 Imai et al. ..... 29/417
6,631,542 B1 * 10/2003 Imai et al. ..... 29/417
6,651,299 B2 * 11/2003 Mitsubayashi et al. ..... 29/90.7
6,663,724 B2 * 12/2003 Imai et al. ..... 148/234
6,684,473 B1 * 2/2004 Yamagishi et al. ..... 29/407.01
6,708,383 B2 * 3/2004 Arikawa et al. ..... 29/407.05

(Continued)

FOREIGN PATENT DOCUMENTS

EP 1 092 488 A2 4/2001

(Continued)

*Primary Examiner*—Essama Omgba
(74) *Attorney, Agent, or Firm*—Foley & Lardner LLP

(57) ABSTRACT

A manufacturing method of an endless metal belt having metal rings built up and differing in circumference, includes the following steps of: a first circumference correction step of expanding each of the metal rings; and a second circumference correction step of expanding each of the metal rings after conducting a solution heat treatment to the expanded metal ring. In the manufacturing method, by executing the first circumference correction step and the second circumference correction step before and after the solution heat treatment, respectively, an expansion quantity for setting a circumference of each of the metal rings to become a predetermined length is attained.

16 Claims, 17 Drawing Sheets

U.S. PATENT DOCUMENTS

| | | | | |
|---|---|---|---|---|
| 6,733,600 | B2 * | 5/2004 | Heishi et al. | 148/230 |
| 6,843,090 | B2 * | 1/2005 | Sato et al. | 72/110 |
| 6,854,310 | B2 | 2/2005 | Narusaki et al. | |
| 6,898,956 | B2 * | 5/2005 | Sato et al. | 72/111 |
| 7,013,691 | B2 * | 3/2006 | Shimoda | 72/110 |
| 7,140,218 | B2 * | 11/2006 | Shimoda | 72/111 |
| 7,150,800 | B2 * | 12/2006 | Nishio et al. | 148/589 |
| 2004/0065128 | A1 * | 4/2004 | Narusaki et al. | 72/111 |

FOREIGN PATENT DOCUMENTS

| | | | | |
|---|---|---|---|---|
| EP | 1 094 121 | A2 | | 4/2001 |
| JP | 58159937 | A | * | 9/1983 |
| JP | 61082909 | A | * | 4/1986 |
| JP | 61082910 | A | * | 4/1986 |
| JP | 63026345 | A | * | 2/1988 |
| JP | 01142021 | A | * | 6/1989 |
| JP | 01142022 | A | * | 6/1989 |
| JP | 11-290971 | A | | 10/1999 |
| WO | WO 02/38302 | A1 | | 5/2002 |

* cited by examiner

PRIOR ART

PRIOR ART

| | LAYER | CIRCUMFERENCE (mm) | THICKNESS (mm) | CORRECTION QUANTITY (mm) |
|---|---|---|---|---|
| BEFORE ROLLING STEP | 1 | 430.00 | 0.30 | |
| | 2 | 430.00 | 0.30 | |
| | 3 | 430.00 | 0.30 | |
| | 4 | 430.00 | 0.30 | |
| | 5 | 430.00 | 0.30 | |
| AFTER ROLLING STEP | 1 | 700.00 | 0.19 | |
| | 2 | 700.00 | 0.19 | |
| | 3 | 700.00 | 0.19 | |
| | 4 | 700.00 | 0.19 | |
| | 5 | 700.00 | 0.19 | |
| AFTER FIRST CIRCUMFERENCE CORRECTION STEP | 1 | 705.00 | 0.18 | 5.00 |
| | 2 | 706.00 | 0.18 | 6.00 |
| | 3 | 707.00 | 0.18 | 7.00 |
| | 4 | 708.00 | 0.18 | 8.00 |
| | 5 | 709.00 | 0.18 | 9.00 |
| AFTER SECOND CIRCUMFERENCE CORRECTION STEP | 1 | 710.00 | 0.18 | 1.00 |
| | 2 | 711.00 | 0.18 | 1.00 |
| | 3 | 712.00 | 0.18 | 1.00 |
| | 4 | 713.00 | 0.18 | 1.00 |
| | 5 | 714.00 | 0.18 | 1.00 |

MANUFACTURING METHOD OF ENDLESS METAL BELT AND MANUFACTURING APPARATUS OF ENDLESS METAL BELT

BACKGROUND OF THE INVENTION

1. Field of the Invention

The invention relates to a manufacturing method of an endless metal belt and manufacturing apparatus of the endless metal belt.

2. Description of the Related Art

A method for manufacturing an endless metal belt used for a non-stage transmission or the like includes, as shown in FIG. 1, for example, a welding step for rounding and welding a workpiece steel, a cutting step for forming metal rings each having a predetermined width, a grinding step for trimming the end face of each metal ring, a rolling step for forming a metal ring having a fixed thickness and a fixed circumference, a solution heat treatment step, a circumference correction step, an ageing step, a nitriding step, and build-up step for forming an endless metal belt consisting of a plurality of layers having different circumferences.

In the circumference correction step, in particular, the metal rings are expanded and, as shown in FIG. 2, metal rings corresponding to respective layers, equal in thickness and different in circumference are formed. For example, Patent Document 1 (Japanese Patent Application Laid-Open Publication No. 11-290971) discloses a method and an apparatus for expanding a metal ring using rollers and correcting the circumference of the metal ring to a predetermined circumference.

However, due to the large expansion quantity of the metal ring in the circumference correction step, the metal ring is greatly contracted thereafter based on elastic deformation. Since the contraction quantity is proportional to the expansion quantity, the contraction quantity varies according to the circumference and the fluctuation of the contraction quantity is not constant. This, therefore, makes it difficult to maintain the accuracy of the circumference of the metal ring.

Thus, it is difficult to determine a combination for building up metal rings and the deterioration of working efficiency and the increase of working man-hour occurs. This disadvantageously pushes up manufacturing cost.

SUMMARY OF THE INVENTION

The present invention has been achieved to solve the disadvantages of the conventional art. It is an object of the present invention to provide an endless metal belt manufacturing method and an endless metal belt manufacturing apparatus capable of improving accuracy for the management of the circumference of a metal ring.

To achieve the above object, a first aspect of the present invention provides a manufacturing method of an endless metal belt having metal rings built up and differing in circumference, comprising: a first circumference correction step of expanding each of the metal rings; and a second circumference correction step of expanding each of the metal rings after conducting a solution heat treatment to the expanded metal ring, wherein by executing the first circumference correction step and the second circumference correction step before and after the solution heat treatment, respectively, an expansion quantity for setting a circumference of each of the metal rings to become a predetermined length is attained.

According to the first aspect of the invention, in the first circumference correction step, the expansion quantity for setting the circumference of each of the metal rings to become a predetermined length is partially attained, and the residual stress of the metal ring caused by the first circumference correction step is eliminated by conducting the solution heat treatment. Due to this, the expansion quantity required in the first circumference correction step becomes small. Accordingly, a contraction quantity after the second circumference correction step becomes small, so that it is possible to improve metal ring circumference management accuracy.

A second aspect of the present invention provides the manufacturing method depending from the first aspect, wherein the expansion quantity attained in the first circumference correction step is corrected to correspond to the circumference set to each of the metal rings differing in circumference.

According to the second aspect of the invention, the expansion quantity in the second circumference correction step can be corrected by a certain value, irrespective of the circumference set to each of the metal rings differing in circumference. The contraction quantity after the second circumference correction step becomes almost fixed and small in irregularity, so that the metal ring circumference management accuracy is further improved.

A third aspect of the present invention provides the manufacturing method depending from the first or the second aspect, wherein the manufacturing method further comprises a rolling step of forming each of the metal rings input in the first circumference correction step by rolling.

According to the third aspect of the invention, it is possible to easily form each metal ring having a fixed thickness and a fixed circumference.

A fourth aspect of the present invention provides the manufacturing method depending from one aspect among the first to the third aspect, wherein in the rolling step, each of the metal rings is input between a work roller and a tension roller, a tension is applied to each of the metal rings by moving the tension roller, and each of the metal rings is rolled by moving a rolling roller to press the rolling roller against the metal ring; the tension roller and the rolling roller are servo-controlled; and based on one of operation patterns of the tension roller and the rolling roller, the other operation pattern is changed.

According to the fourth aspect of the invention, since it is possible to highly accurately position the tension roller and the rolling roller and control a tension applied to each metal ring to be fixed, rolling accuracy is improved.

A fifth aspect of the present invention provides the manufacturing method depending from one aspect among the first to the fourth aspect, wherein the work roller and the rolling roller are set to have an equal circumferential speed.

According to the fifth aspect of the invention, since it is possible to eliminate the slippage between the metal ring and the roller (work roller or rolling roller), the rolling accuracy is further improved. In addition, it is possible to improve transferability of transferring the form of the work roller and prevent the metal rings from being scratched. Further, since it is possible to prevent the occurrence of friction and heat, it is possible to lengthen the lives of the respective rollers.

A sixth aspect of the present invention provides the manufacturing method depending from one aspect among the first to the fifth aspect, wherein, in the first circumference correction step and the second circumference correction step, each of the metal rings is input between the work roller and the tension roller, and is expanded by moving the tension roller until the circumference of each of the metal rings becomes a set circumference; and the tension roller is servo-controlled.

According to the sixth aspect of the invention, since it is possible to highly accurately position the tension roller and the tension applied to each metal ring can be controlled to be fixed, accuracy for the expansion quantity of the metal ring is improved. Therefore, it is possible to further improve the metal ring circumference management accuracy.

A seventh aspect of the present invention provides the manufacturing method depending from one aspect among the first to the sixth aspect, wherein the manufacturing method further comprises a circumference measurement step of measuring the circumference of each of the metal rings before the second circumference correction step.

According to the seventh aspect of the invention, since the expansion quantity in the second circumference correction step can be set based on the actually measured circumference of the metal ring, it is possible to further improve the metal ring circumference management accuracy.

An eighth aspect of the present invention provides the manufacturing method depending from one aspect among the first to the seventh aspect, wherein, in the circumference measurement step, based on a moving length of the tension roller necessary to apply a predetermined tension to each of the metal rings input between the work roller and the tension roller, the circumference of each of the metal rings is measured; and movement of the tension roller is controlled based on a combination of pressure control and position control.

According to the eighth aspect of the invention, since it is possible to control the tension applied to each of the metal ring to be fixed during the circumference measurement, it is possible to prevent an excessive tension from being applied to the metal ring to thereby plastically deform the metal ring. Circumference measurement accuracy is, therefore, improved.

A ninth eighth aspect of the present invention provides a manufacturing apparatus of an endless metal belt having metal rings built up and differing in circumference, comprising: a first circumference correction section for expanding each of the metal rings; and a second circumference correction section for expanding each of the metal rings after conducting a solution heat treatment to the expanded metal ring, wherein by using the first circumference correction section and the second circumference correction before and after the solution heat treatment, respectively, an expansion quantity for setting a circumference of each of the metal rings to become a predetermined length is attained.

According to the ninth aspect of the invention, the expansion quantity for setting the circumference of each of the metal rings to become a predetermined length is partially attained by the first circumference correction section, and the residual stress of the metal ring caused by the first circumference correction section is eliminated by conducting the solution heat treatment. Due to this, the expansion quantity by the first circumference correction section after the expansion becomes small. Accordingly, a contraction quantity after the expansion by the second circumference correction section becomes small, so that it is possible to improve metal ring circumference management accuracy.

A tenth aspect of the present invention provides the manufacturing apparatus depending from the ninth aspect, wherein the expansion quantity attained by the first circumference correction section is corrected to correspond to the circumference set to each of the metal rings differing in circumferences.

According to the tenth aspect of the invention, the expansion quantity required for the second circumference correction section can be corrected by a certain value, irrespective of the circumference set to each of the metal rings differing in circumference. The contraction quantity after the expansion by the second circumference correction section becomes almost fixed and small in irregularity, so that the metal ring circumference management accuracy is further improved.

An eleventh aspect of the present invention provides the manufacturing apparatus depending from the ninth or the tenth aspect, wherein the manufacturing apparatus further comprises rolling section for forming each of the metal rings input to the first circumference correction section by rolling.

According to the eleventh aspect of the invention, it is possible to easily form each metal ring having a fixed thickness and a fixed circumference. In addition, since it is possible to continuously execute the rolling and the expansion of the metal ring, it is possible to dispense with devices for inputting, taking out and transporting the metal rings. It is, therefore, possible to shorten working time and prevent the metal rings from being scratched. Besides, since disturbance following the input, takeout and transportation of the metal rings is suppressed, metal ring expansion accuracy is improved.

A twelfth aspect of the present invention provides the manufacturing apparatus depending from one aspect among the ninth to the eleventh aspect, wherein the rolling section applies a tension to each of the metal rings input between a work roller and a tension roller by moving the tension roller, and rolls each of the metal rings by moving the rolling roller to press the rolling roller against the metal ring; the tension roller and the rolling roller are servo-controlled; and based on one of operation patterns of the tension roller and the rolling roller, the other operation pattern is changed.

According to the twelfth aspect of the invention, since it is possible to highly accurately position the tension roller and the rolling roller and control a tension applied to each metal ring to be fixed, rolling accuracy is improved.

A thirteenth aspect of the present invention provides the manufacturing apparatus depending from one aspect among the ninth to the twelfth aspect, wherein the work roller and the rolling roller are set to have an equal circumferential speed.

According to the thirteenth aspect of the invention, since it is possible to eliminate the slippage between the metal ring and the roller (work roller or rolling roller), the rolling accuracy is further improved. In addition, it is possible to improve transferability of transferring the form of the work roller and prevent the metal rings from being scratched. Further, since it is possible to prevent the occurrence of friction and heat, it is possible to lengthen the lives of the respective rollers.

A fourteenth aspect of the present invention provides the manufacturing apparatus depending from one aspect among the ninth to the thirteenth aspect, wherein the first circumference correction section and the second circumference correction section expand each of the metal rings input between the work roller and the tension roller by moving the tension roller until the circumference of each of the metal rings becomes a set circumference; and the tension roller is servo-controlled.

According to the fourteenth aspect of the invention, since it is possible to highly accurately position the tension roller and the tension applied to each metal ring can be controlled to be fixed, accuracy for the expansion quantity of the metal ring is improved. Therefore, it is possible to further improve the metal ring circumference management accuracy.

A fifteenth aspect of the present invention provides the manufacturing apparatus depending from one aspect among the ninth to the fourteenth aspect, wherein the manufacturing apparatus further comprises a circumference measurement section for measuring the circumference of each of the metal rings.

According to the fifteenth aspect of the invention, since the expansion quantity attained by the second circumference correction section can be set based on the actually measured circumference of the metal ring, it is possible to further improve the metal ring circumference management accuracy.

A sixteenth aspect of the present invention provides the manufacturing apparatus depending from one aspect among the ninth to the fifteenth aspect, wherein the circumference measurement section measures the circumference of each of the metal rings input between the work roller and the tension roller based on a moving length of the tension roller necessary to apply a predetermined tension to each of the metal rings; and movement of the tension roller is controlled based on a combination of pressure control and position control.

According to the sixteenth aspect of the invention, since it is possible to control the tension applied to each of the metal ring to be fixed during the circumference measurement, it is possible to prevent an excessive tension from being applied to the metal ring to thereby plastically deform the metal ring. Circumference measurement accuracy is, therefore, improved.

BRIEF DESCRIPTION OF THE ACCOMPANYING DRAWINGS

DETAILED DESCRIPTION OF THE PREFERRED EMBODIMENTS

The embodiments of the present invention will be described hereinafter with reference to the drawings.

Figure 1:
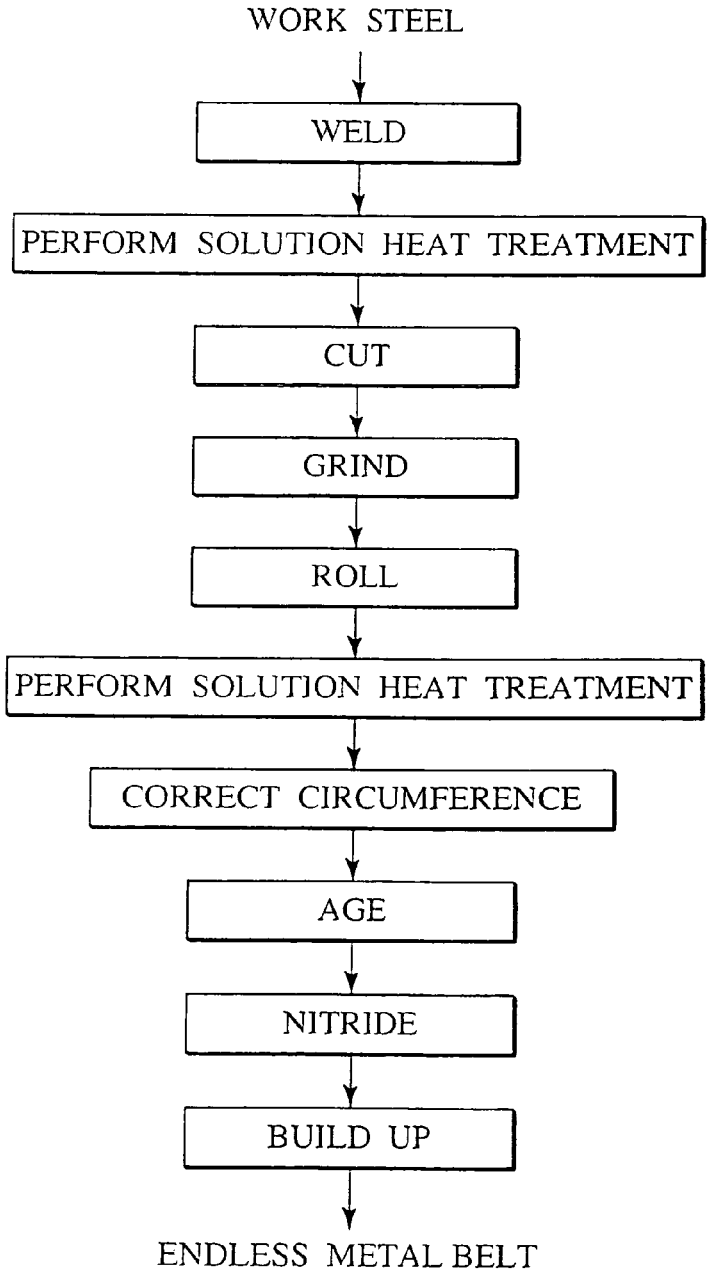
FIG. 1 is a flow chart for explaining a conventional endless metal belt manufacturing method.
Figure 2:
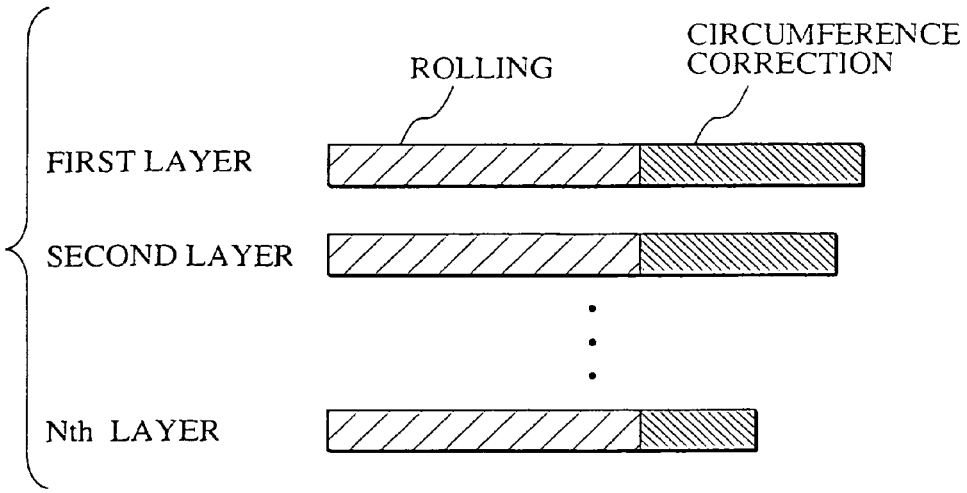
FIG. 2 is a conceptual view for explaining the change of circumference in a rolling step and a circumference correction step shown in FIG. 1.
Figure 3:
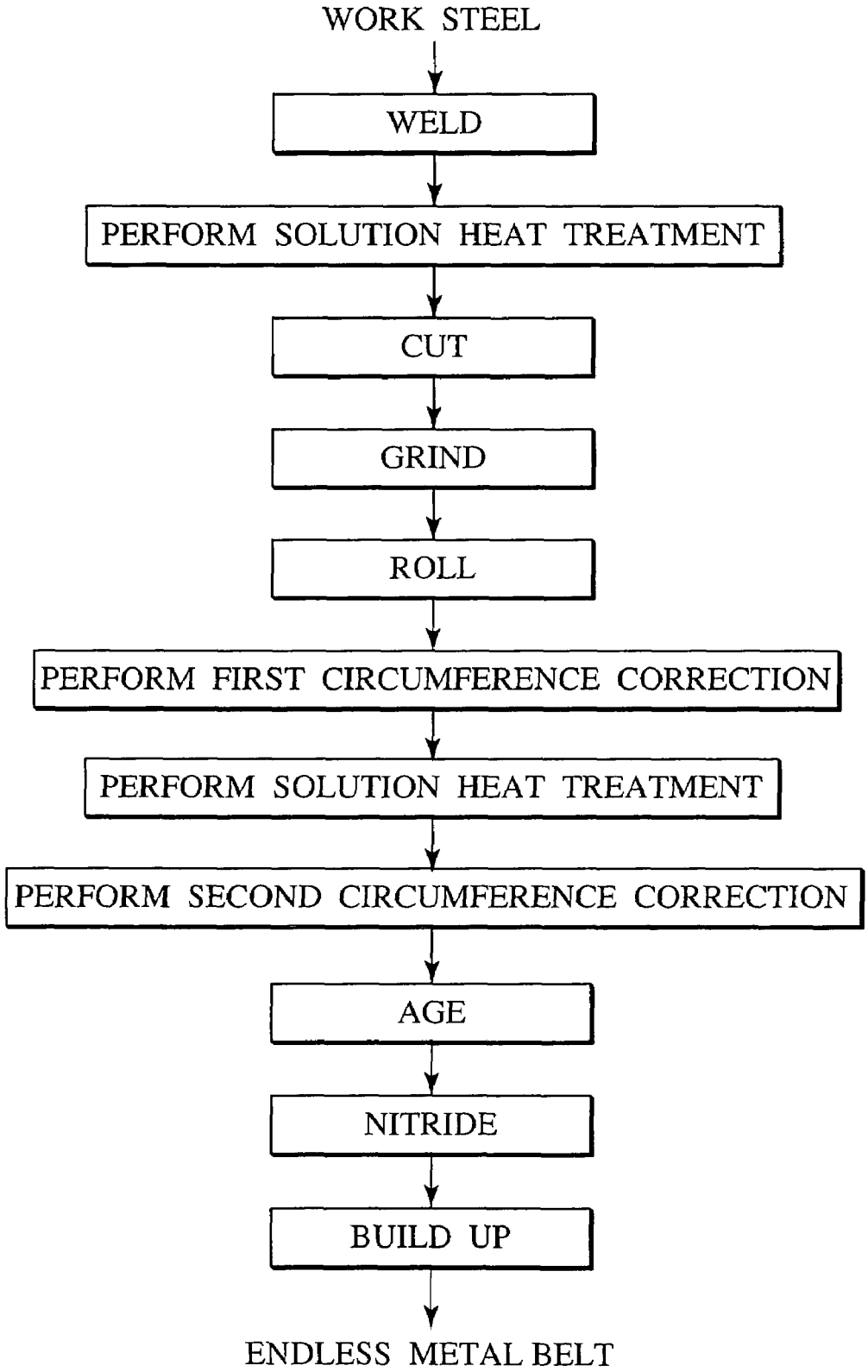
FIG. 3 is a flow chart for explaining an endless metal belt manufacturing method in one embodiment according to the present invention.

FIG. 3 is a flow chart for explaining an endless metal belt manufacturing method in one embodiment according to the present invention. As shown in FIG. 3, the manufacturing method includes a welding step, a solution heat treatment step, a cutting step, a grinding step, a rolling step, a first circumference correction step, a solution heat treatment step, a second circumference correction step, an ageing step, a nitriding step and a build-up step.

First, in the welding step, a workpiece steel made of a special steel such as a maraging steel is rounded and welded to provide a cylindrical workpiece steel. In the solution heat treatment step, welded alloy structures are homogenized. In the cutting step, the cylindrical workpiece steel is cut to obtain metal rings each having a predetermined width. In the grinding step, the end faces of the metal rings are ground and thereby trimmed.

In the rolling step, the thicknesses of the metal rings are decreased and the circumferences thereof are expanded, thereby forming metal rings each having a predetermined thickness and a predetermined circumference. In other words, metal rings each having a fixed thickness and a fixed circumference are formed. Since the circumference is made fixed, it is possible to highly accurately control the thicknesses without complicating the rolling step.

Figures 4, 5:
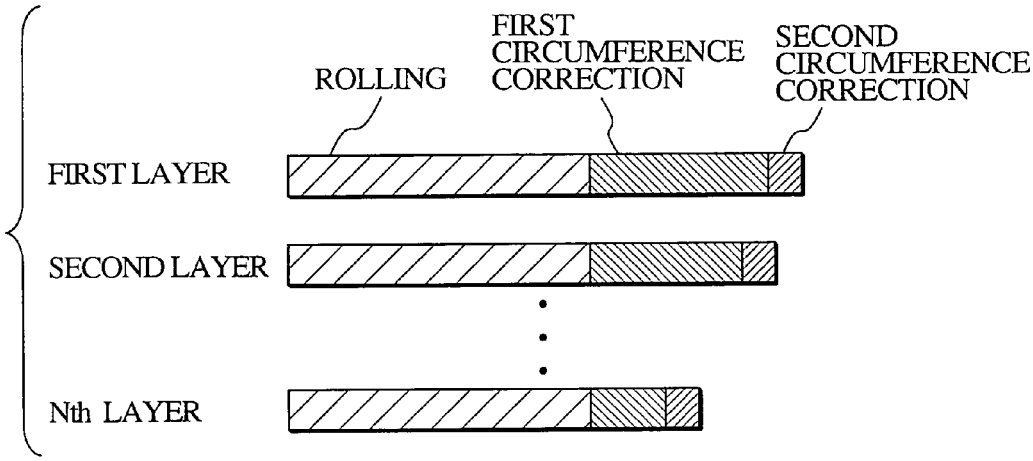
FIG. 4 is a conceptual view for explaining the change of circumference in a rolling step, a first circumference correction step and a second circumference correction step shown in FIG. 3.
FIG. 5 is an explanatory view for correction quantities in the first circumference correction step and the second circumference correction step.

FIG. 4 is a conceptual view for explaining the change of circumferences in the rolling step, the first circumference correction step and the second circumference correction step. As shown in FIG. 4, the first circumference correction step and the second circumference correction step executed with the solution heat treatment step put therebetween enable an expansion quantity for obtaining each metal ring having a predetermined circumference to be obtained.

Specifically, in the first circumference correction step, the metal rings which have been just rolled are expanded to form metal rings having a fixed thickness and different circumferences. It is noted that each metal ring is contracted to correspond to the expansion quantity after the first circumference correction step. Due to this, the expansion quantities are corrected so as to correspond to the circumferences set for the respective metal rings having different circumferences.

FIG. 5 shows one example of correction quantities in the first circumference correction step and the second circumference correction step if an endless metal belt consisting of five layers of metal rings is to be manufactured. For example, if the circumference that is set after the first circumference correction step of the metal ring (applied to the first layer) is 705.00 mm, the correction quantity of the metal ring is 5.00 mm. If the circumference that is set after the first circumference correction step of the metal ring (applied to the fifth layer) is 709.00 mm, the correction quantity of the metal ring is 9.00 mm.

In the solution heat treatment step, a heat treatment is conducted to each metal ring right after the first circumference correction step. As a result, the residual stresses of the metal rings caused by the first circumference correction step are released, whereby it is possible to suppress the influence of the first circumference correction step and improve basic strength by the microfabrication of structures.

In the second circumference correction step, the circumferences of the metal rings are expanded to final circumferences, respectively. The correction quantity of each metal ring in this step is smaller than that in the first circumference correction step and the respective metal rings are almost equal in correction quantity. For example, as shown in FIG. 5, the correction quantities of the metal rings after the first circumference correction step range from 5 mm to 9 mm according to the circumferences set to the respective metals. The correction quantities of the metal rings after the second circumference correction step are fixed to 1.00 mm, irrespective of the circumferences set to the respective metal rings.

Namely, the expansion quantities so as to set the respective metal rings to have predetermined circumferences are partially attained in the first circumference correction step, and the residual stresses of the metal rings caused by the first circumference correction step are eliminated in the solution heat treatment step. Due to this, the expansion quantities of the metal rings required in the second circumference correction step become small. Accordingly, the contraction quantities thereof after the second circumference correction step also become small, making it possible to improve accuracy for the management of the circumferences of the metal rings.

In addition, it is possible to correct the respective expansion quantities in the second circumference correction step by a certain value, irrespective of the circumferences set to the respective metal rings having different circumferences. As a result, the contraction quantities of the metal rings after the second circumference correction step become almost fixed and small, thereby further improving the accuracy for the management of the circumferences of the metal rings.

The contraction of each metal ring after the circumference correction continues about 24 hours. Due to this, if the circumference correction is executed twice after the solution heat treatment step, only the contraction quantity increases and the accuracy cannot be improved.

In the ageing step, the influence of the second circumference correction step is eliminated. In the nitriding step, the surfaces of the metal rings are cured so as to improve wearing resistance and fatigue resistance. In the build-up step, the metal rings having different circumferences and obtained in the preceding steps are built up. Consequently, an endless metal belt consisting of a plurality of layers having different circumferences is formed.

Figure 6:
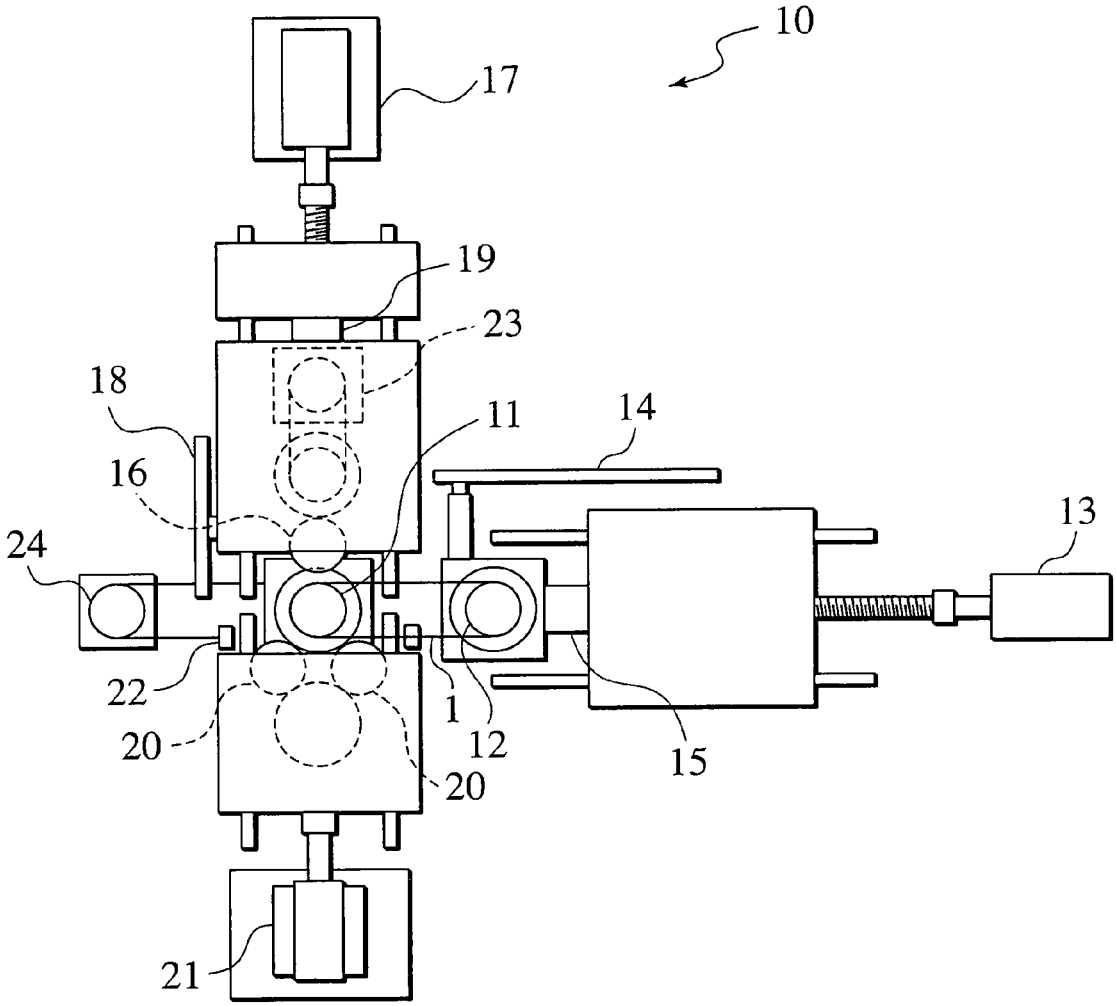
FIG. 6 is a schematic diagram for explaining an endless metal belt manufacturing apparatus in one embodiment according to the present invention.

Referring next to FIG. 6, an endless metal belt manufacturing apparatus 10 in one embodiment according to the present invention will be described.

As will be described later, the manufacturing apparatus 10 includes a first circumference correction section for expanding metal rings and a second circumference correction section for expanding the metal rings after conducting a solution heat treatment to the respective expanded metal rings. The first circumference correction section and the second circumference correction section used before and after the solution heat treatment enable attaining an expansion quantity for setting the circumference of each metal ring at a predetermined circumference.

The manufacturing apparatus 10 also includes a rolling section for rolling the metal rings. By using the rolling section, it is possible to easily form metal rings each having a fixed thickness and a fixed circumference. Further, since the rolling and expansion of the metal rings can be executed continuously, it is possible to dispense with devices for inputting, taking out and transporting the metal rings and the like. Therefore, it is possible to shorten working time and prevent the metal rings from being scratched. Moreover, since disturbance following the input, takeout and transportation of the metal rings is suppressed, metal ring expansion accuracy is improved. It is noted that it is possible to execute the rolling and the circumference correction using different devices at need.

Further, the manufacturing apparatus 10 includes a circumference measurement section for measuring the circumferences of the metal rings. Therefore, it is possible to set the expansion quantities of the metal rings attained by the second circumference correction section based on the actually measured circumferences of the metal rings. It is thus possible to further improve the metal ring circumference management accuracy. Besides, if the circumference measurement is executed before the rolling step, it is possible to set rolling conditions based on the actually measured circumferences of the metal rings and, therefore, improve rolling accuracy.

Specifically, the manufacturing apparatus 10 includes a work roller 11 and a tension roller 12 with a metal ring 1 put therebetween, a rolling roller 16 for putting, together with the work roller 11, the metal ring 1 therebetween, and backup rollers 20 for supporting the work roller 11. It is noted that the tension roller 12 and the backup rollers 20 are free rollers.

Further, the manufacturing apparatus 10 includes a driver 24 driving the work roller 11 to rotate freely forward and backward, a driver 13 for applying a tension to the metal ring 1, a driver 23 driving the rolling roller 16 to rotate freely forward or backward, a driver 17 for linearly moving the rolling roller 16 so as to put the metal ring 1 between the rolling roller 16 and the work roller 11 and to roll the metal ring 1, and a driver 21 for linearly moving the backup rollers 20 to bring the backup rollers 20 into contact with the work roller 11 so as to eliminate the flexure of the work roller 11 caused by the tension roller 12 and the rolling roller 16.

It is noted that the drivers 13 and 17 are servo motors and that the tension roller 12 and the rolling roller 16 are servo-controlled and the speeds and thrusts thereof can be changed during the movement.

Furthermore, the manufacturing apparatus 10 includes a scale 14 for detecting the moving length of the tension roller 12, a pressure meter 15 for detecting the tension of the tension roller 12 during the movement thereof, s scale 18 for detecting the moving length of the rolling roller 16, a pressure meter 19 for detecting the pressing force of the rolling roller 16 during the movement thereof, and a stopper 22 for detecting the moving length of each backup roller 20.

The detection results of the scale 14 and the pressure meter 15 are fed back to make it possible to dynamically change the operation pattern (position, speed, and tension) of the tension roller 12. Likewise, the detection results of the scale 18 and the pressure meter 19 are fed back to make it possible to dynamically change the operation pattern of the tension roller 16.

It is also possible to change the operation pattern of the tension roller 12 based on the detection result of the operation pattern of the rolling step 16 and change the operation pattern of the rolling roller 16 based on the detection result of the operation pattern of the tension roller 12.

In the rolling step, therefore, it is possible to highly accurately position the tension roller 12 and the rolling roller 16 and control tensions applied to the metal rings to be fixed, thereby improving rolling accuracy.

Furthermore, in the first circumference correction step and the second circumference correction step, it is possible to highly accurately position the tension roller 12 and control tensions applied to the metal rings to be fixed, thereby improving accuracy for metal ring expansion quantities. Accordingly, it is possible to further improve the accuracy for the management of the metal ring circumferences.

Figure 7:
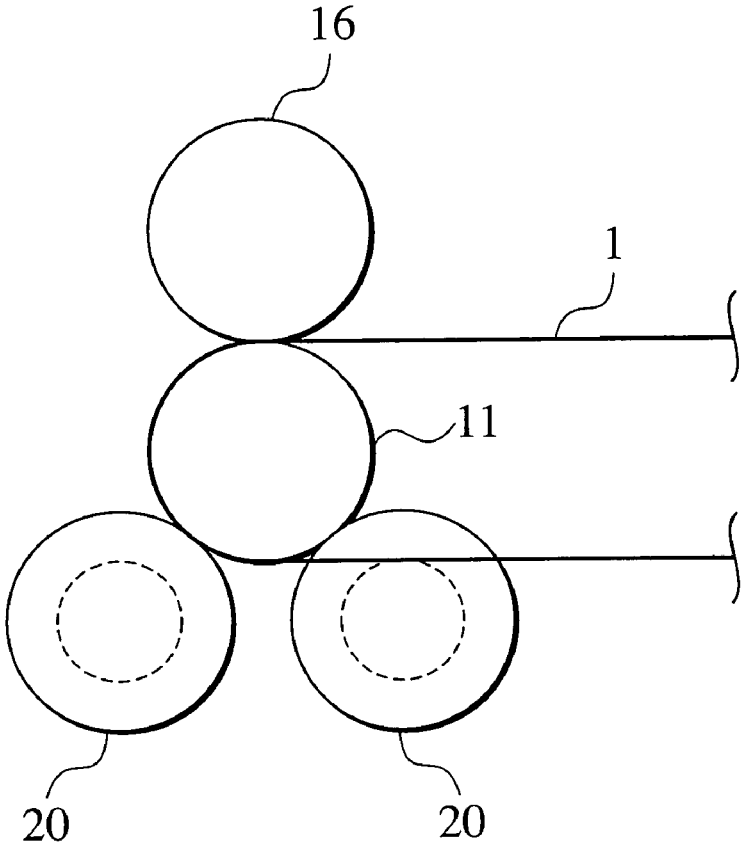
FIG. 7 is a side view for explaining the configuration of a backup roller in the endless metal belt manufacturing apparatus.
Figure 8:
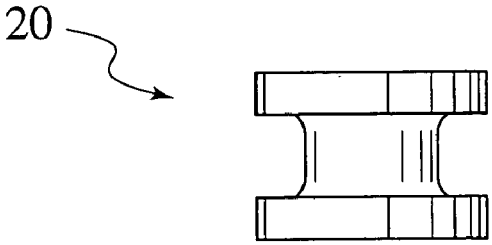
FIG. 8 is a plan view of the backup roller.

As shown in FIGS. 7 and 8, the backup rollers 20 are formed to be out of contact with the metal ring 1. In addition, by providing a plurality of backup rollers 20, it is possible to improve the effect of eliminating the flexure of the work roller 11.

Next, the rolling step executed by the manufacturing apparatus 10 will be described.

Figure 9A:
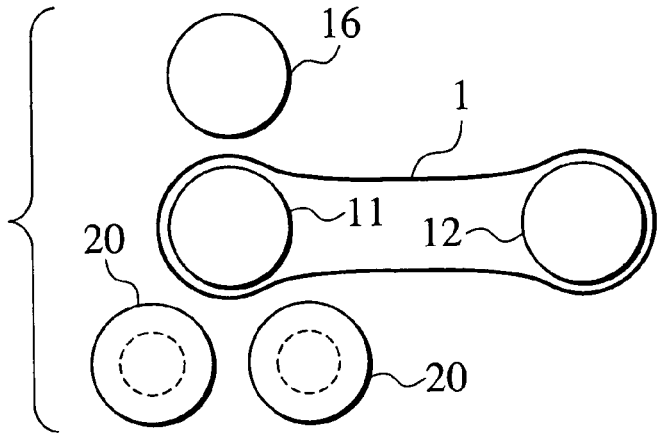
FIGS. 9A, 9B and 9C are side views for explaining the rolling step by the endless metal belt manufacturing apparatus.
Figure 9B:
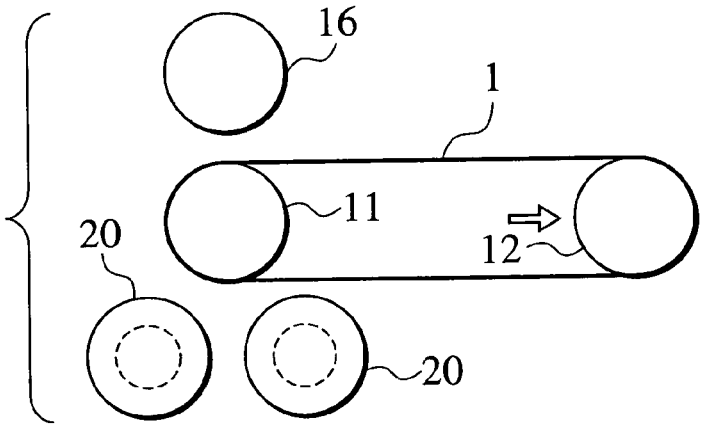

In the rolling step, the metal ring 1 the end face of which is ground in the grinding step is first input between the work roller 11 and the tension roller 12 (see FIG. 9A). The driver 13 drives the tension roller 12 to linearly move, thereby applying a tension to the metal ring 1 and winding the metal ring 1 around the work roller 11 and the tension roller 12 (see FIG. 9B).

Figure 9C:
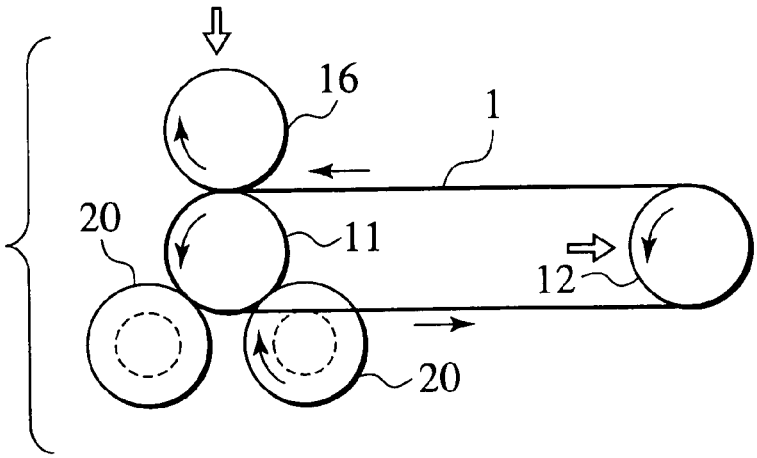

Thereafter, the driver 21 drives the backup rollers 20 to linearly move, thereby bringing the backup rollers 20 in contact with the work roller 11. The driver 23 drives work roller 11 to rotate (e.g., at 30 rpm), thereby rotating the metal ring 1 between the work roller 11 and the tension roller 12. Further, the driver 17 drives the rolling roller 16 to be pressed against the metal ring 1 with a predetermined pressing force, thereby rolling the metal ring 1 (see FIG. 9C).

At this time, the work roller 11 and the rolling roller 16 are driven to rotate by the drives 23 and 17, respectively, to make the work roller 11 and the rolling roller 16 have an equal circumferential speed.

Therefore, it is possible to eliminate slippage between the metal ring 1 and the roller (work roller 11 or rolling roller 16) and thereby further improve the rolling accuracy. In addition, it is possible to improve the transferability of transferring the form of the work roller and prevent the occurrence of scratches. Further, since it is also possible to prevent the generation of friction and heat, it is possible to lengthen the lives of the work roller 11 and the rolling roller 16.

It is noted that the tension roller 12 is driven to constantly apply a fixed tension to the metal ring 1. In addition, it is preferable to set the moving distance of the tension roller 12 to correspond to the expansion quantity of the metal ring 1 by the function of the rolling roller 16. For example, it is possible to determine the moving speed and moving distance of the tension roller 12 based on information on the moving speed and moving distance of the rolling roller 16 detected by means of the scale 18 and the pressing force detected by means of the pressure meter 19.

The rotation of the metal ring 1 can be applied by the rolling roller 16. Normally, however, the rotation of the metal ring 1 is applied by the work roller 11. If the form of the work roller 11 is transferred onto the inner periphery of the metal ring 1 during rolling, the rotation of the metal ring 1 is preferably applied by the rolling roller 16. If the work roller 11 and the rolling roller 16 are driven to rotate synchronously with each other and the circumference speeds thereof are made fixed, it is possible to improve the accuracy and transferability.

The rolling roller 16 is pressed until the thickness of the metal ring 1 reaches a predetermined value. The recognition of whether the thickness reaches the predetermined value is executed based on the scale 18. If the thickness of the metal ring 1 reaches the predetermined value, the pressing force of the rolling roller 16 is weakened so as not to exhibit a rolling effect but to be able to drive the metal ring 1 to rotate.

If the rotation of the metal ring 1 is applied by the work roller 11, the rolling roller 16 can be put back in a direction away from the work roller 11 at need.

Figure 10:
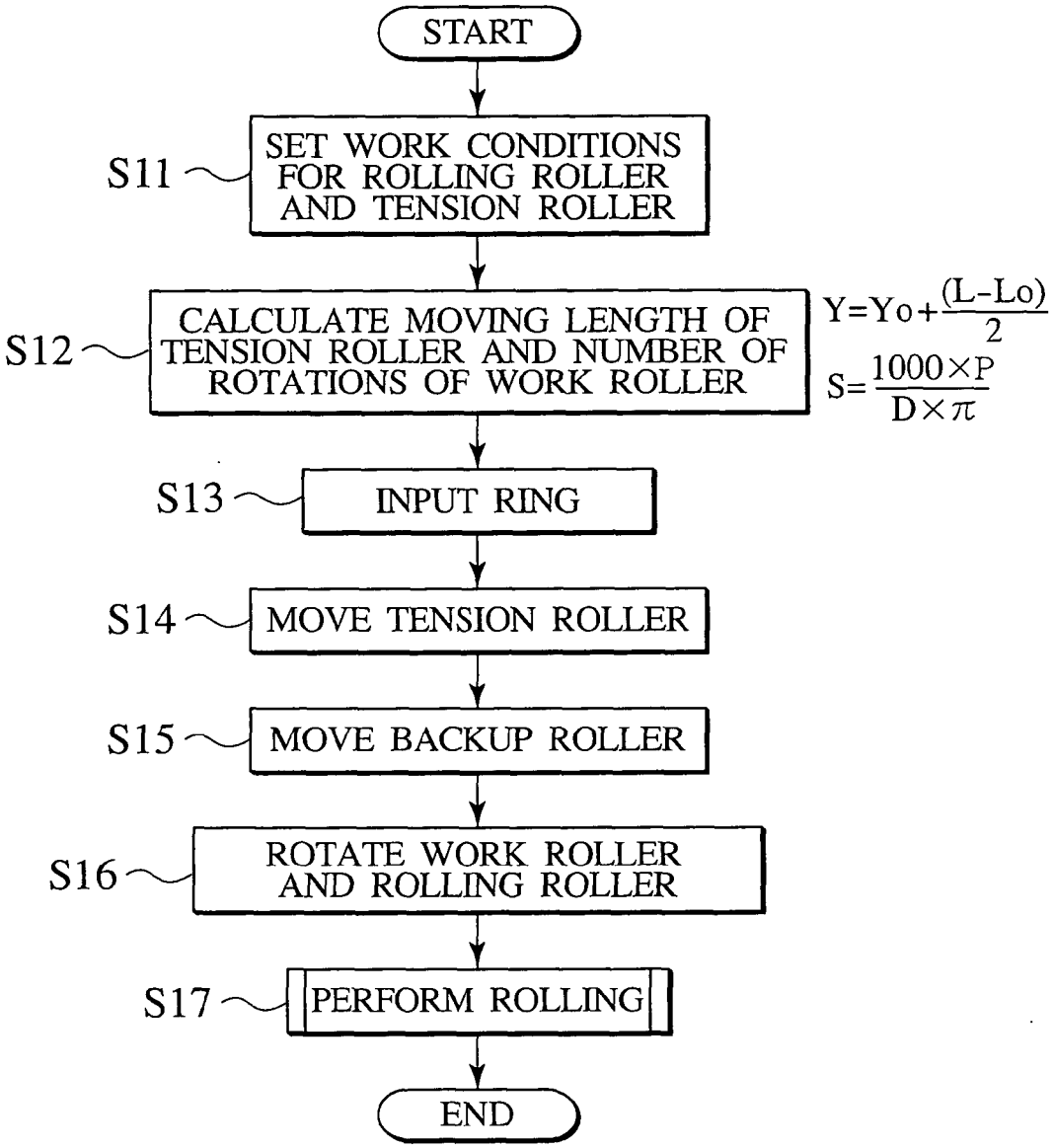
FIG. 10 is a flow chart for explaining the rolling step.

Referring next to the flow chart of FIG. 10, the rolling step will be described in detail.

First, work conditions for the rolling roller 16 and the tension roller 12 are set (in S11). The work conditions are specified for each of a plurality of separate steps constituting the rolling step and they include a distance, a thrust, a circumferential speed and a moving speed. It is noted that the number of steps is set at need and can be set at, for example, "1".

The moving length (absolute value) Y of the tension roller 12 and the number of rotations of the work roller 11 for each step are calculated (in S12).

For example, the moving length Y of the tension roller 12 can be obtained by subtracting the circumference $L_0$ of a standard ring from the circumference L of the input metal ring, dividing the subtraction result by "2" and adding the measured coordinate $Y_0$ of the standard ring to the division result. The number of rotations S of the work roller 11 can be obtained by multiplying the circumferential speed P [m/min] of the tension roller 12 by "1000" and dividing the multiplication result by a value obtained by multiplying the outside diameter D [mm] of the rolling roller 16 by "π". It is noted that the coefficient "1000" is used so as to make the unit of the circumferential speed P of the tension roller 12 equal to that of the outside diameter D of the rolling roller 16.

Thereafter, the metal ring is input between the work roller 11 and the tension roller 12 (in S13). The tension roller 12 is moved to a grip position at which the tension roller 12 can exhibit a predetermined tension (in S14), and the backup rollers 20 are moved to support the work roller 11 (in S15). The work roller 11 and the rolling roller 16 are driven to rotate (in S16), thereby executing a rolling processing (in S17).

Next, the rolling processing in S17 will be described. The rolling processing is executed by operating the rolling roller 16 and the tension roller 12 almost simultaneously. Due to this, the rolling processing will be described for the rolling roller 16 and the tension roller 12 separately while roughly separating the operation related to the rolling roller 16 and that related to the tension roller 12.

Figure 11:
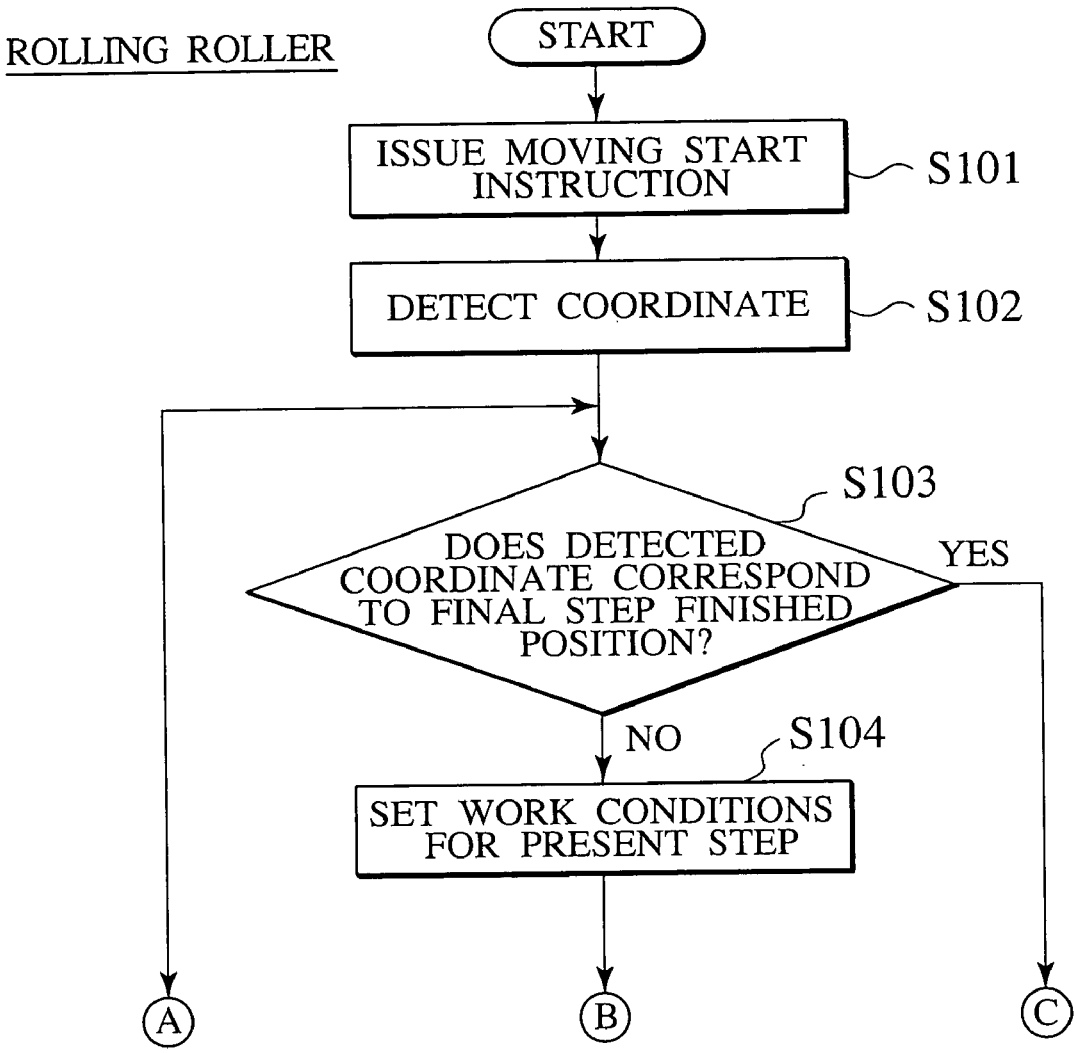
FIG. 11 is a flow chart for explaining the operation of a rolling roller in a rolling processing shown in FIG. 10.
Figure 12:
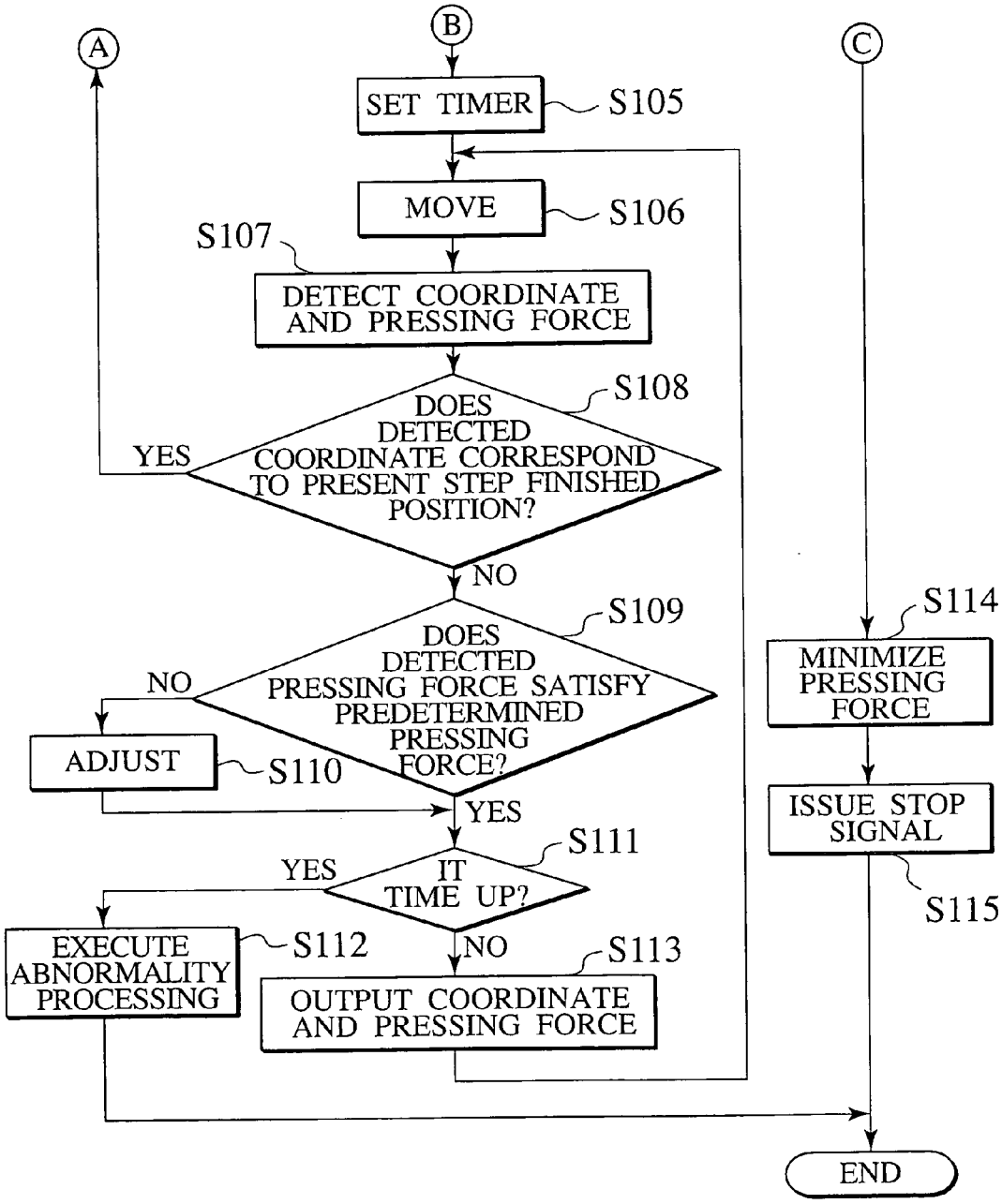
FIG. 12 is a flow chart following the flow chart of FIG. 11 for explaining the operation of the rolling roller.

FIGS. 11 and 12 are flow charts for explaining the operation of the rolling roller 16 in the rolling processing.

A moving start instruction to start moving the rolling roller 16 is issued first (in S101), and the present coordinate of the rolling roller 16 is detected (in S102). It is then determined whether the detected coordinate correspond to the final step finished position of the rolling roller 16 (in S103).

If the detected coordinate corresponds to the final step finished position ('YES' in S103), then the pressing force of the rolling roller 16 is minimized (in S114), a stop signal for stopping the tension roller 12 is issued (in S115) and the processing is finished.

On the other hand, if the detected coordinate does not correspond to the final step finished position ('NO' in S193), work conditions for the present step are set and a timer is set (in S104 and S105, respectively).

If the rolling roller 16 is moved (in S106), the coordinate and pressing force of the rolling roller 16 are detected (in S107). It is then determined whether the detected coordinate corresponds to the present step finished position of the rolling roller 16 (in S108).

If the detected coordinate corresponds to the present step finished position ('YES' in S108), the next step is set as a present step and the processing returns to S103. If the detected coordinate does not correspond to the present step finished position ('NO' in S108), it is further determined whether the detected pressing force satisfies a predetermined pressing force (in S109).

If the detected pressing force does not satisfy the predetermined pressing force ('NO' in S109), the pressing force is adjusted (in S110). If the detected pressing force satisfies the predetermined pressing force ('YES' in S109), S110 is skipped.

Next, it is determined whether the passing time of the timer exceeds a predetermined value (time is up) (in S111). If time is up ('YES' in S111), an abnormality processing is executed (in S112) and the processing is finished. If time is not up ('NO' in S111), the present coordinate and pressing force of the rolling roller 16 are output (in S113) and the processing returns to S106.

Figure 13:
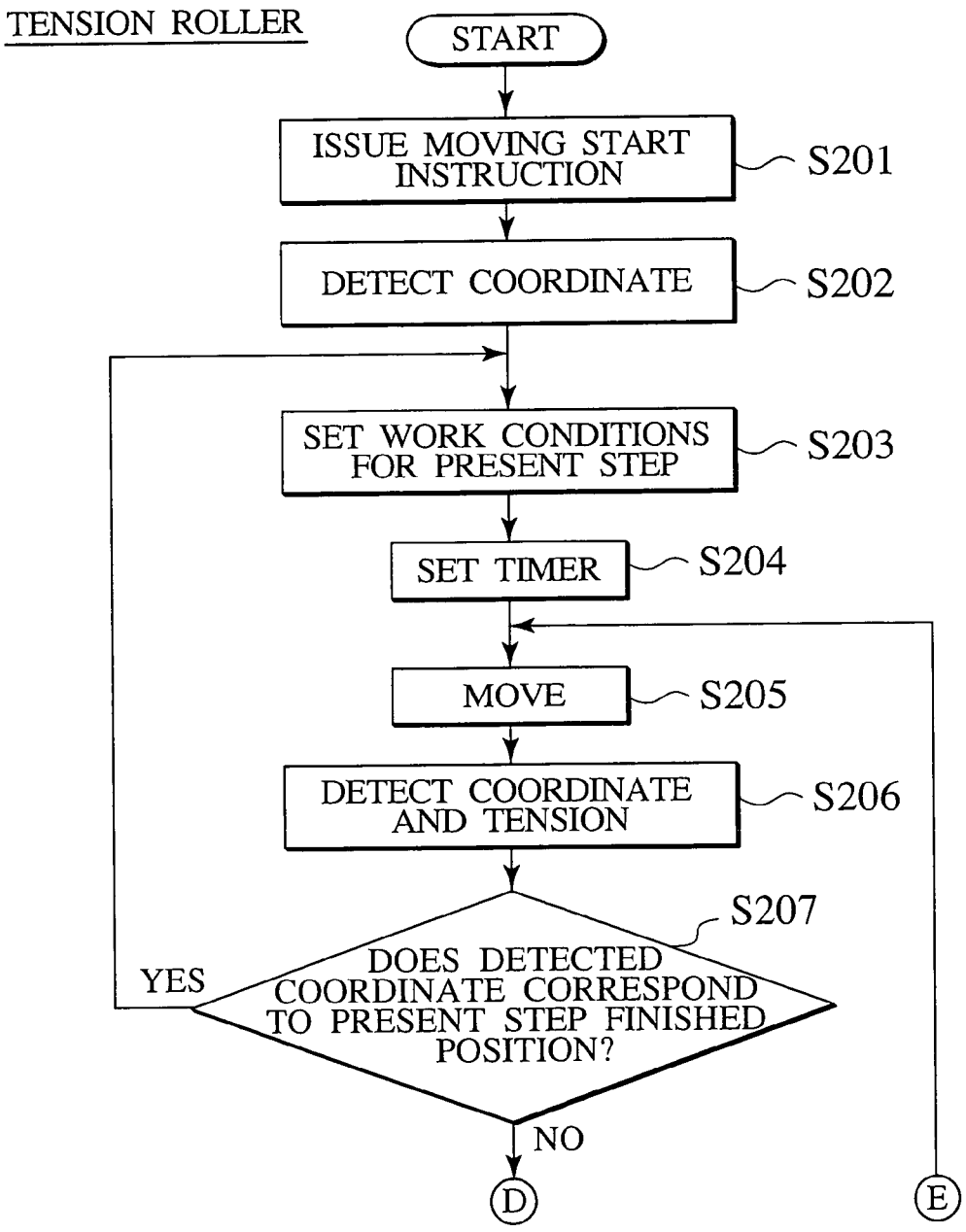
FIG. 13 is a flow chart for explaining the operation of a tension roller in the rolling processing shown in FIG. 10.
Figure 14:
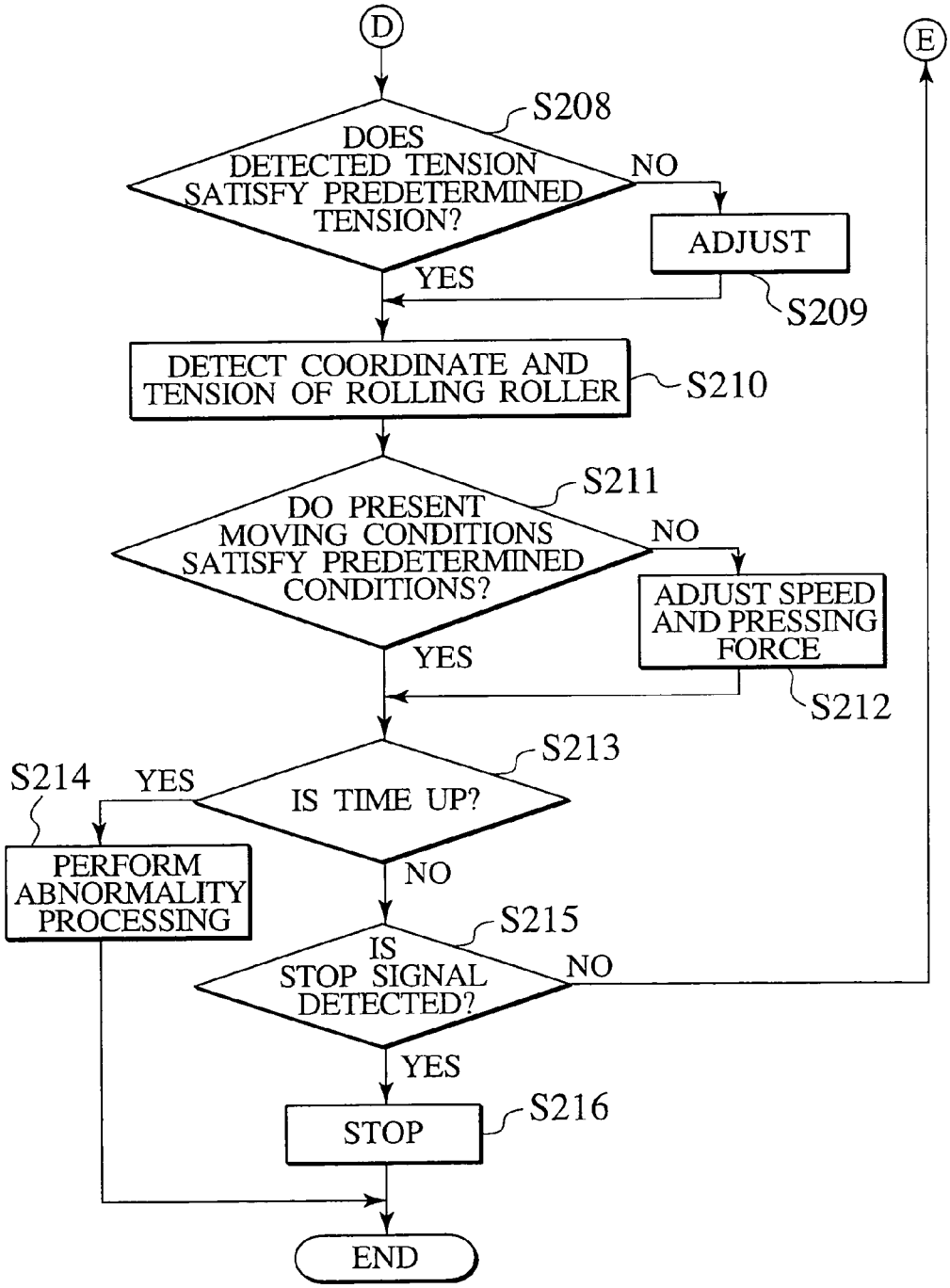
FIG. 14 is a flow chart following the flow chart of FIG. 13 for explaining the operation of the tension roller.

Referring next to FIGS. 13 and 14, the operation of the tension roller 12 in the rolling processing will be described.

First, a moving start instruction to start moving the tension roller 12 is issued (in S201), and the present coordinate of the tension roller 12 is detected (in S202). Work conditions for a present step are set and the timer is set (in S203 and S204, respectively).

Next, the tension roller 12 is moved (in S205), and the coordinate and tension of the tension roller 12 are detected (in S206). It is then determined whether the detected coordinate corresponds to the present step finished position of the tension roller 12 (in S207).

If the detected coordinate corresponds to the present step finished position ('YES' in S207), the next step is set as a present step and the processing returns to S203. If the detected coordinate does not correspond to the present step finished position ('NO' in S207), it is further determined whether the detected tension of the tension roller 12 satisfies a predetermined value (in S208).

If the detected tension of the tension roller 12 does not satisfy the predetermined value ('NO' in S208), the tension is adjusted (in S209). If the detected tension of the tension roller 12 satisfies the predetermined value ('YES' in S208), S209 is skipped.

Next, the coordinate and pressing force of the rolling roller 16 output in the step S113 are detected (in S210). It is determined whether present moving conditions satisfy predetermined conditions (in S211). If the present moving conditions do not satisfy the predetermined conditions ('NO' in S211), the speed and pressing force of the rolling roller 16 are adjusted (in S212). If the present moving conditions satisfy the predetermined conditions ('YES' in S211), S213 is skipped.

It is determined whether the passing time of the timer exceeds a predetermined value (time is up) (in S213). If time is up ('YES' in S213), an abnormality processing is execute (in S214) and the processing is finished. If time is not up ('NO' in S213), it is further determined whether the stop signal issued in S115 is detected (in S215).

If the stop signal is not detected ('NO' in S215), the processing returns to S205. If the stop signal is detected ('YES' in S215), the tension roller 12 is stopped (in S216) and the processing is finished.

Next, the first circumference correction step executed by the manufacturing apparatus 10 will be described. It is noted that the first circumference correction step is executed continuously with the rolling step without taking out the rolled metal ring 1.

Figure 15A:
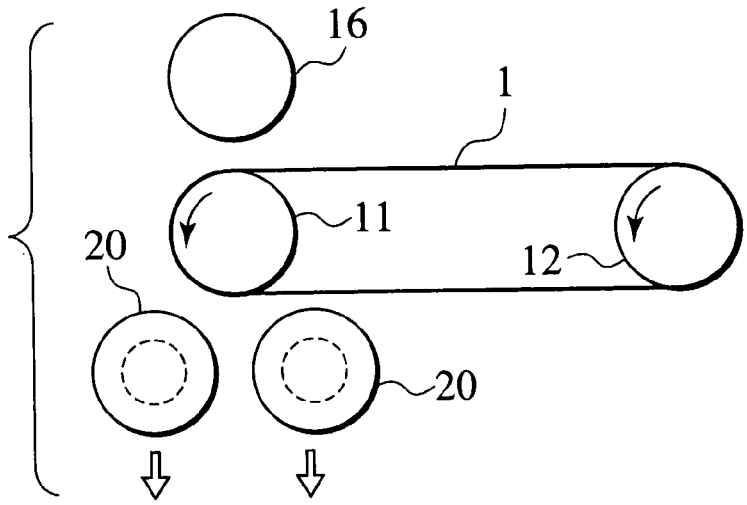
FIGS. 15A, 15B and 15C are side views for explaining the first circumference correction step executed by the endless metal belt manufacturing apparatus.

First, the driver 24 keeps driving the work roller 11 to rotate, thereby keeping the rotation of the metal ring 1 (see FIG. 15A).

Figure 15B:
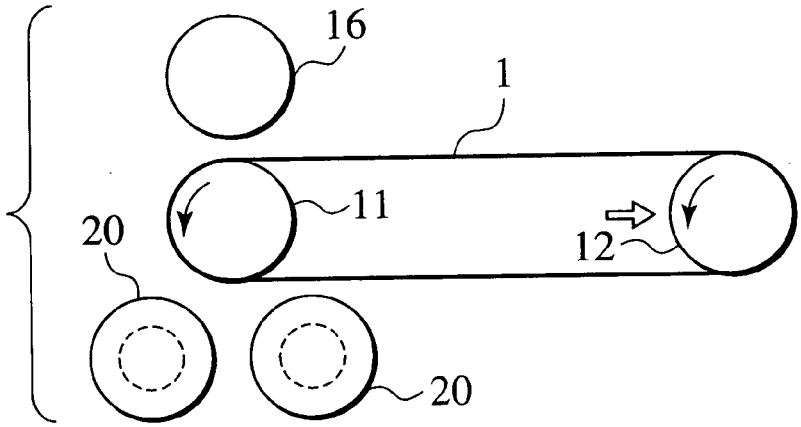

Next, the driver 13 drives the tension roller 12 to linearly move until the circumference of the metal ring 1 becomes a predetermined circumference (see FIG. 15B). The detection as to whether the circumference of the metal ring 1 becomes a predetermined circumference is executed by the scale 14.

Figure 15C:
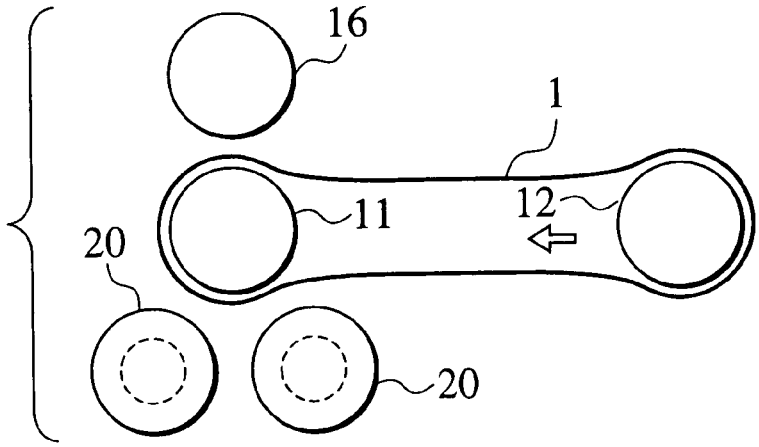

If it is detected that the circumference of the metal ring 1 becomes the predetermined circumference, the driver 13 drives the tension roller 12 to be put back toward the work roller 11 (see FIG. 15C).

Figure 16:
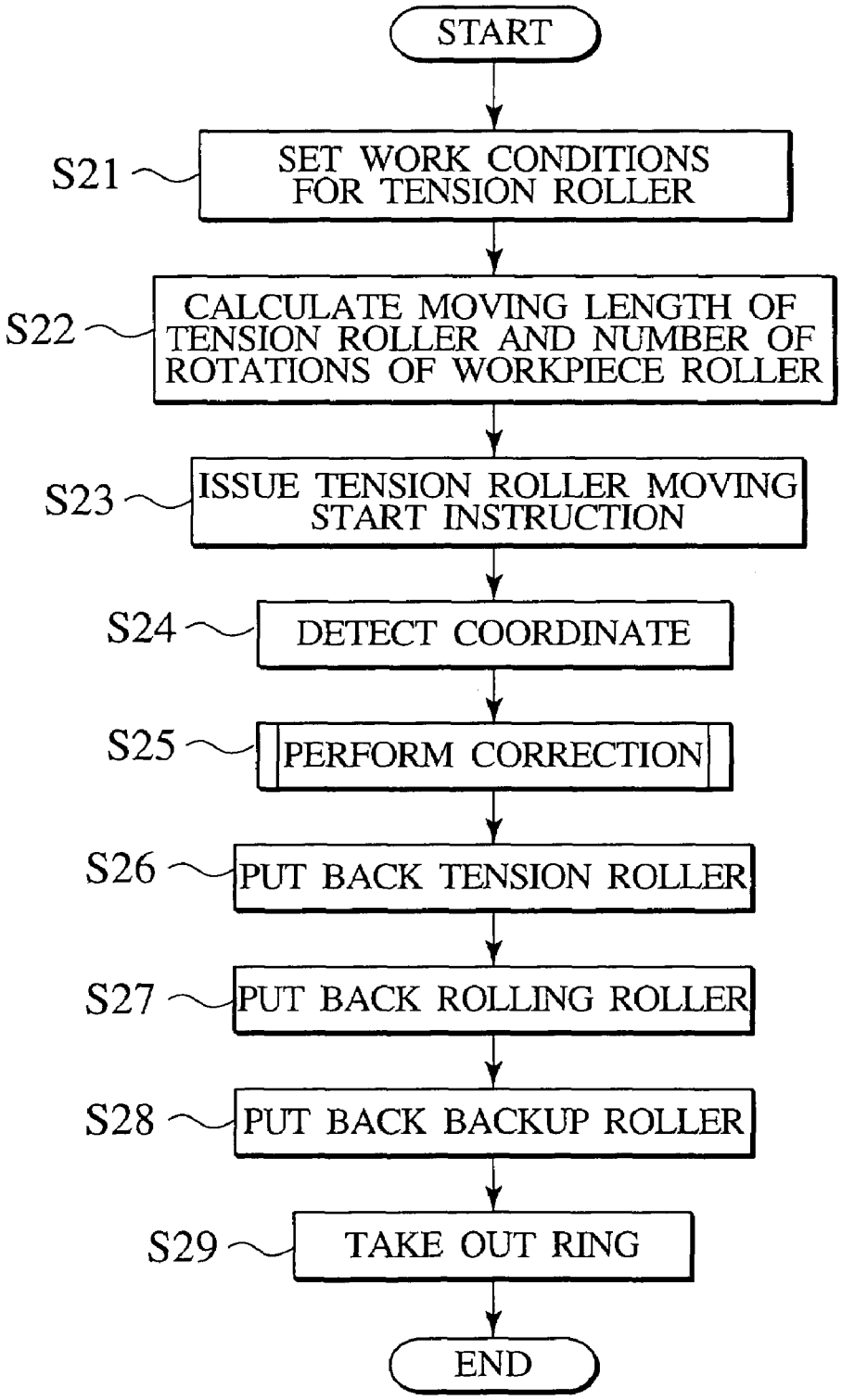
FIG. 16 is a flow chart for explaining the first circumference correction step.

Referring next to the flow chart of FIG. 16, the first circumference correction step will be described in detail.

First, similarly to S11 and S12, work conditions for the tension roller 12 are set (in S21), and the moving length of the tension roller 12 and the number of rotations of the work roller 11 are calculated (in S22).

A moving start instruction to start moving the tension roller 12 is issued (in S23), and the present coordinate of the tension roller 12 is detected (in S24). Thereafter, a correction (expansion of circumference) is executed so that the metal ring 1 has a predetermined circumference (in S25).

After the correction, the tension roller 12, the rolling roller 16 and the backup rollers 20 are put back (in S26 to S28, respectively). To go to the solution heat treatment step, the metal ring is taken out (in S29).

Figure 17:
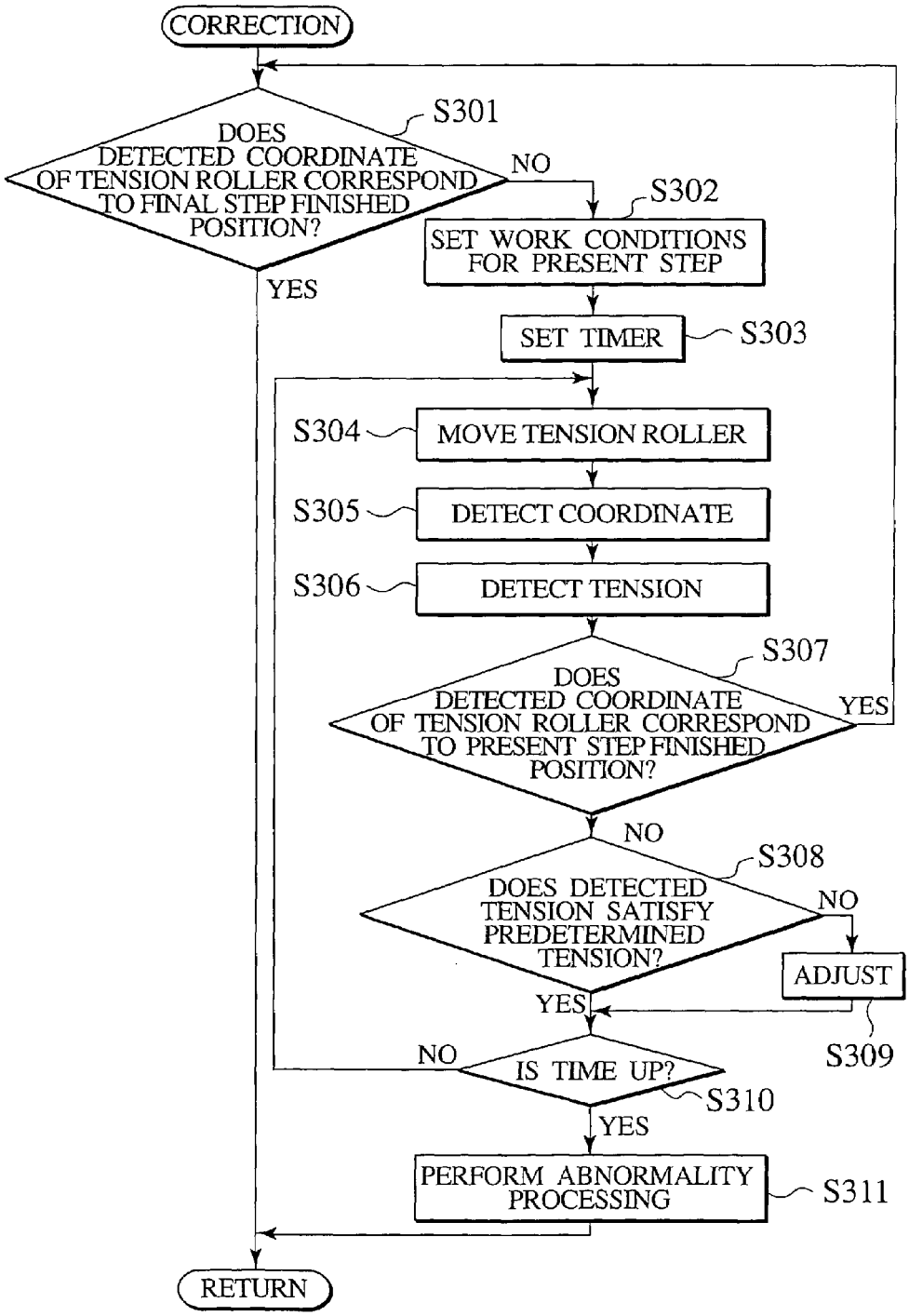
FIG. 17 is a flow chart for explaining a correction processing shown in FIG. 16.

Referring next to the flow chart of FIG. 17, the correction processing in S25 will be described.

First, it is determined whether the detected coordinate of the tension roller 12 corresponds to the final step finished position of the tension roller 12 (in S301).

If the detected coordinate of the tension roller 12 corresponds to the final step finished position ('YES' in S301), the processing is finished. If the detected coordinate of the tension roller 12 does not correspond to the final step finished position ('NO' in S301), work conditions for the present step are set and the timer is set (in S302 and S303, respectively).

Next, the tension roller 12 is moved (in S304), and the coordinate and tension of the tension roller 12 are detected (in S305 and S306, respectively). It is then determined whether the detected coordinate of the tension roller 12 corresponds to the final step finished position of the tension roller 12 (in S307).

If the detected coordinate of the tension roller 12 corresponds to the final step finished position ('YES' in S307), the next step is set as a present step and the processing returns to S301. If the detected coordinate of the tension roller 12 does not correspond to the final step finished position ('NO' in S307), it is further determined whether the detected tension satisfies a predetermined value (in S308).

If the detected tension does not satisfy the predetermined value ('NO' in S308), the tension of the tension roller 12 is adjusted (in S309). If the detected tension satisfies the predetermined value ('YES' in S308), S309 is skipped.

Next, it is determined whether the passing time of the timer exceeds a predetermined value (time is up) (in S310). If time is up ('YES' in S310), the processing returns to S304. If time is not up ('NO' in S310), an abnormality processing is executed (in S311) and the processing is finished.

Since the second circumference correction step is almost equal to the first circumference correction step except for work conditions for the metal ring 1, it will not be described herein.

Next, the circumference measurement step executed by the manufacturing apparatus 1 will be described.

First, the metal ring 1 as a circumference measurement target is input between the work roller 11 and the tension roller 12 (see FIG. 9A). The driver 13 drives the tension roller 12 to linearly move, thereby applying a tension to the metal ring 1 and winding the metal ring 1 around the work roller 11 and the tension roller 12 (see FIG. 9B).

Thereafter, the driver 21 drives the backup rollers 20 to linearly move, thereby bringing the backup rollers 20 in contact with the work roller 11. The driver 23 drives the work roller 11 to rotate, thereby rotating the metal ring 1 between the work roller 11 and the tension roller 12.

At this time, the movement of the tension roller 12 is controlled so as to be able to apply a predetermined tension (a measurement tension so as to be able to exhibit the metal ring expansion effect but drive the metal ring 1 to rotate) to the metal ring 1.

For example, if static friction is large and the variation of a load for moving the tension roller 12 is large, control is switched from pressure (tension) control to position control to forcedly move the tension roller 12 by a predetermined length. That is, the tension roller 12 is controlled to be moved based on a combination of the pressure control and the position control.

Accordingly, it is possible to control the tension applied to the metal ring 1 during the circumference measurement to be fixed, so that it is possible to prevent an excessive tension from being applied to the metal ring and the metal ring from being plastically deformed and improve circumference measurement accuracy.

Thereafter, if a stable predetermined tension is continuously applied to the metal ring within a predetermined measurement time range, the distance between the work roller 11 and the tension roller 12 (the moving length of the tension roller 12) is detected by the scale 14. Further, an average circumference based on a plurality of times of detections is utilized so as to improve the measurement accuracy, thereby calculating the circumference of the metal ring.

Figure 18:
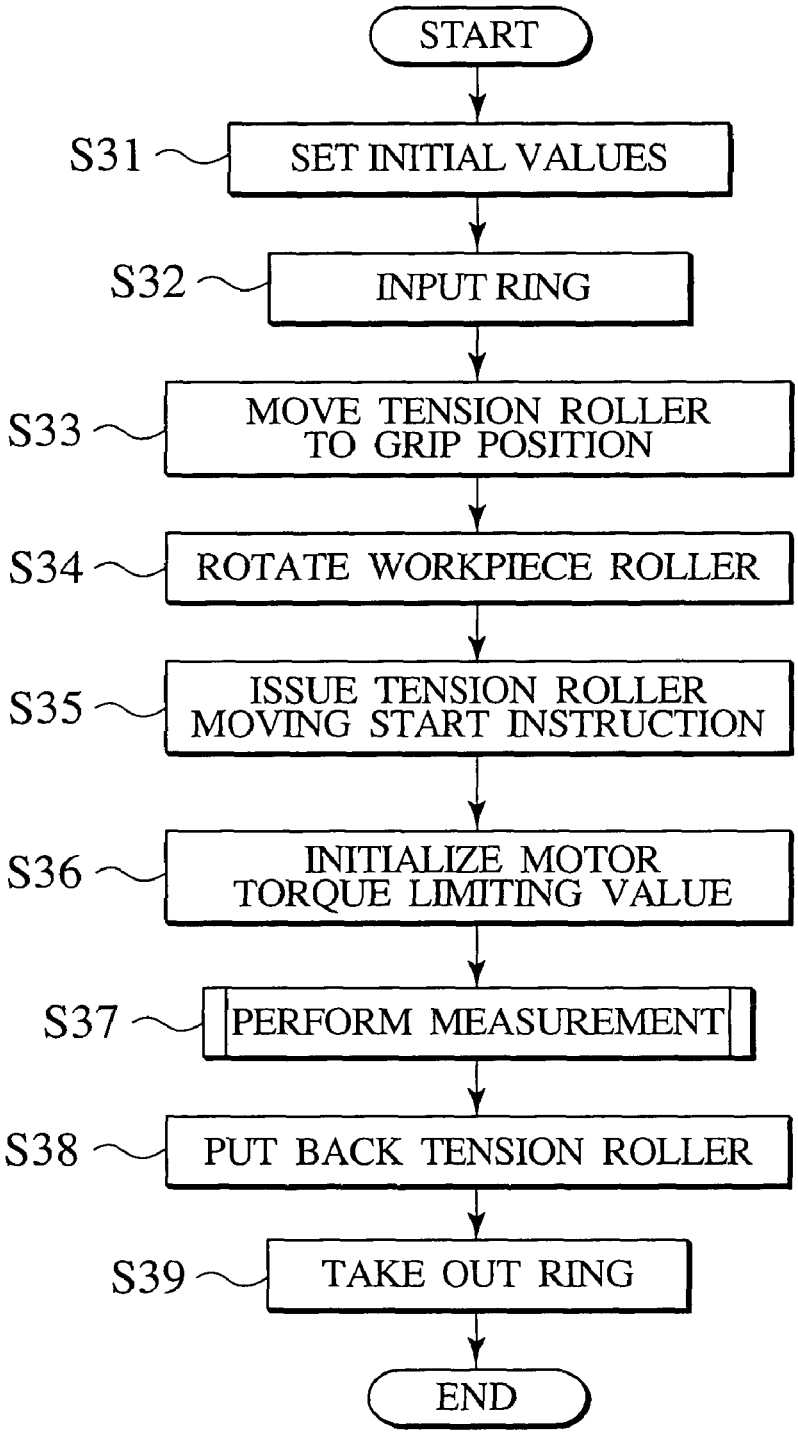
FIG. 18 is a flow chart for explaining the measurement of circumference made by the endless metal belt manufacturing apparatus.

Referring next to the flow chart of FIG. 18, the circumference measurement step will be described in detail.

First, initial values are set (in S31). The initial values include those of the measured coordinate of the standard ring, the number of rotations of the work roller 11, the measured tension, the acceptable variation width of the measured tension, the measurement time range, the acceptable variation width of the detected coordinate of the tension roller 12, the number of times of detection for obtaining the average, the forced moving length of the tension roller 12 and a maximum number of times of the change of the setting of a motor torque limiting value by the driver 13.

Next, the metal ring 1 is input between the work roller 11 and the tension roller 12 (in S32). The tension roller 12 is moved to a grip position at which the tension roller 12 can exhibit a predetermined tension (in S33). The work roller 11 is rotated (in S34), and a moving start instruction to start moving the tension roller 12 is issued (in S35).

The motor torque limiting value is initialized (in S36), and a measurement processing for measuring the circumference of the metal ring is executed (in S37). After the completion of the measurement, the tension roller 12 is put back (in S38) and the metal ring is taken out (in S39).

Figure 19:
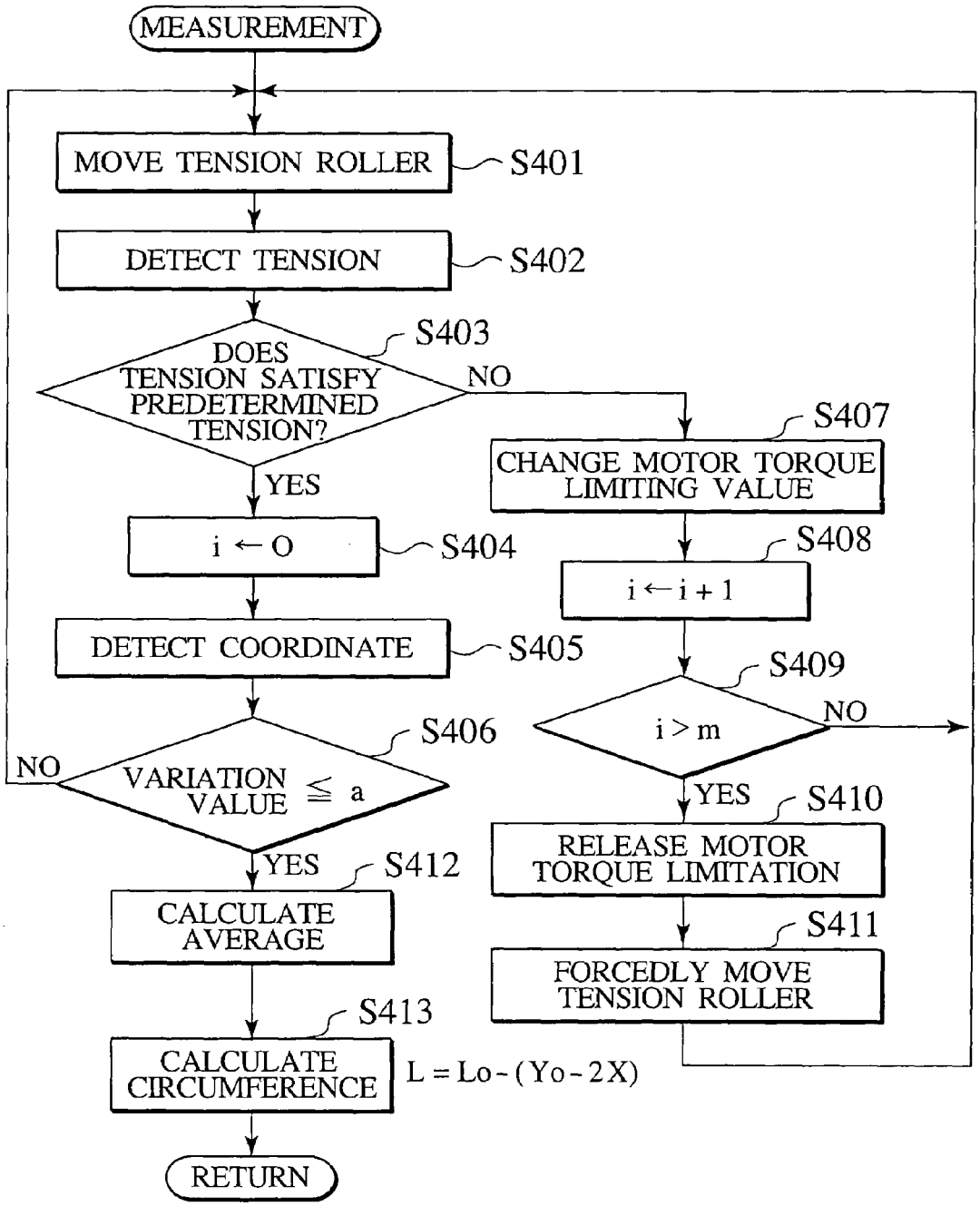
FIG. 19 is a flow chart for explaining a measurement processing shown in FIG. 18.

Referring next to the flow chart of FIG. 19, the measurement processing in S37 will be described.

First, the tension roller 12 is moved (in S401) and the tension of the tension roller 12 is detected (in S402). It is determined whether the detected tension satisfies a predetermined tension (in S403).

If the detected tension satisfies the predetermined tension ('YES' in S403), a parameter i is set at "0" (in S404) and the coordinate of the tension roller 12 is detected (in S405). It is determined whether the detected coordinate within a set measurement time range (e.g., several seconds) falls within an acceptable variation width a (e.g., several micrometers) (in S406).

If the detected coordinate does not fall within the acceptable variation width a ('NO' in S406), the processing returns to S401. If the detected coordinate falls within the acceptable variation width a ('YES' in S406), coordinate detection is repeated by a set number of times and an average coordinate is calculated (in S412). If the number of times of detection is set at, for example, "4", the coordinate of the tension roller 12 is detected whenever the work roller 11 rotates by 90 degrees.

Based on the average detected coordinate X, the circumference L of the input metal ring 1 is calculated (in S413) and the processing is finished. To be specific, the circumference L is obtained by subtracting a value obtained by multiplying the average detected coordinate X by 2 from the measured coordinate $Y_0$ of the standard ring and subtracting the subtraction result from the circumference Lo of the standard ring.

On the other hand, if the detected tension does not satisfy the predetermined tension ('NO' in S403), the setting of the motor torque limiting value is changed and "1" is added to the parameter i (in S408).

Next, it is determined whether the parameter i exceeds a maximum number of times m of the change of the setting of the motor torque limiting value (in S409). If the parameter i does not exceed the maximum number of times m ('NO' in S409), the processing returns to S401.

If the parameter i exceeds the maximum number of times m ('YES' in S409), motor torque limitation is released (in S410). Then, the tension roller 12 is forcedly moved by a set length (in S411) and the processing returns to S401.

The entire contents of Japanese Patent Applications P2002-255941 (filed on Aug. 30, 2002) and P2002-266922 (filed on Sep. 12, 2002) are incorporated herein by reference.

It is noted that the present invention is not limited to the above-stated embodiments but that various changes and modifications can be made to the present invention within the scope of claims that follow.

What is claimed is:

1. A manufacturing method of an endless metal belt having metal rings built up and differing in circumference, comprising the steps of:

a first circumference correction step of expanding each of the metal rings;

a solution heat treatment step; and a second circumference correction step of expanding each of the metal rings after conducting a solution heat treatment to the expanded metal ring, wherein by executing the first circumference correction step and the second circumference correction step before and after the solution heat treatment, respectively, an expansion quantity for setting a circumference of each of the metal rings to become a predetermined length is attained.

2. The manufacturing method of an endless metal belt according to claim 1, wherein an expansion quantity attained in the first circumference correction step is corrected to correspond to a circumference set to each of the metal rings differing in circumference.

3. The manufacturing method of an endless metal belt according to claim 1, wherein the manufacturing method further comprises a rolling step of forming each of the metal rings input in the first circumference correction step by rolling.

4. The manufacturing method of an endless metal belt according to claim 1, wherein:

each of the metal rings is input between a work roller and a tension roller in the rolling step;

a tension is applied to each of the metal rings by moving the tension roller in the rolling step;

each of the metal rings is rolled by moving a rolling roller to press the rolling roller against the metal ring in the rolling step;

the tension roller and the rolling roller are servo-controlled;

based on one of operation patterns of the tension roller and the rolling roller, the other operation pattern is changed.

5. The manufacturing method of an endless metal belt according to claim 1, wherein a work roller and a rolling roller are set to have an equal circumferential speed.

6. The manufacturing method of an endless metal belt according to claim 1, wherein:

each of the metal rings is input between a work roller and a tension roller in the first and the second circumference correction steps; and each of the metal rings is expanded by moving the tension roller until the circumference of each of the metal rings becomes a set circumference of each of the metal rings becomes a set circumference in the first and the second circumference correction steps.

7. The manufacturing method of an endless metal belt according to claim 1, further comprising the step of:

measuring the circumference of each of the metal rings before the second circumference correction step.

8. The manufacturing method of an endless metal belt according to claim 7, wherein:

based on a moving length of a tension roller necessary to apply a predetermined tension to each of the metal rings input between a work roller and the tension roller, the circumference of each of the metal rings is measured, in the circumference measurement step; and movement of the tension roller is controlled based on a combination of pressure control and position control.

9. A manufacturing apparatus of an endless metal belt having metal rings built up and differing in circumference, comprising:

a machine to perform a first circumference correction on one of the metal rings and a second circumference correction on the metal ring, wherein the first circumference correction and the second circumference correction expand the metal ring; and a heat treatment device to perform a solution heat treatment on the metal ring;

wherein the machine to perform the first circumference correction and the second circumference correction is adapted to perform the second circumference correction after a solution heat treatment has been performed by the heat treatment device;

wherein the machine comprises:

a work roller and a tension roller that are configured to perform circumference correction on the metal ring when the metal ring is placed around the circumferences of the work roller and the tension roller;

a first driver configured to drive the work roller so as to rotate the work roller;

a second driver configured to apply a tension to the metal ring;

a rolling roller configured to perform a rolling step on the metal ring, wherein the rolling roller is configured to rotatably sandwich the metal ring between the work roller and the rolling roller;

a third driver configured to drive the rolling roller so as to rotate the rolling roller; and a fourth driver configured to move the rolling roller against the work roller so as to press the metal ring, wherein the fourth driver is configured to move the rolling roller in a direction away from the work roller and the metal ring;

wherein the work roller and the rolling roller are driven by the first and third drivers to rotate synchronously with each other.

10. The manufacturing apparatus of an endless metal belt according to claim 9, wherein by using the machine to perform the first circumference correction and the second circumference correction before and after the solution heat treatment, respectively, an expansion quantity for setting a circumference of each of the metal rings to become a predetermined length is attained;

wherein the expansion quantity attained by the first circumference correction is corrected to correspond to the circumference set to each of the metal rings differing in circumferences.

11. The manufacturing apparatus of an endless metal belt according to claim 9, wherein the work roller and the rolling roller are set to have an equal circumferential speed.

12. The manufacturing apparatus of an endless metal belt according to claim 9, further comprising:

a circumference measurement section measuring the circumference of each of the metal rings.

13. The manufacturing apparatus of an endless metal belt according to claim 12, wherein:

the circumference measurement section measures the circumference of each of the metal rings input between the work roller and the tension roller based on a moving length of the tension roller necessary to apply a predetermined tension to each of the metal rings; and movement of the tension roller is controlled based on a combination of pressure control and position control.

14. The manufacturing apparatus of an endless metal belt according to claim 9, wherein the machine comprises:

a first scale that is configured to detect a moving length of the tension roller; and a second scale that is configured to detect a moving length of the rolling roller, wherein the second scale is configured to feed the detected moving length back to the fourth driver.

15. A manufacturing apparatus of an endless metal belt having metal rings built up and differing in circumference, comprising:

a means for performing a first circumference correction on one of the metal rings and a second circumference correction on the metal ring, wherein the first circumference correction and the second circumference correction expand the metal ring; and a means for performing a solution heat treatment on the metal ring;

wherein the means for performing the first circumference correction and the second circumference correction is adapted to perform the second circumference correction after a solution heat treatment has been performed so that an expansion quantity for setting a circumference of each of the metal rings to become a predetermined length is attained;

wherein the means for performing the first circumference correction and the second circumference correction comprises:

a work roller and a tension roller that are configured to perform the circumference correction on the metal ring when the metal ring is placed around the circumferences of the work roller and the tension roller;

a first driver configured to drive the work roller so as to rotate the work roller;

a second driver configured to apply a tension to the metal ring;

a rolling roller configured to perform a rolling step on the metal ring, wherein the rolling roller is configured to rotatably sandwich the metal ring between the work roller and the rolling roller;

a third driver configured to drive the rolling roller so as to rotate the rolling roller; and a fourth driver configured to move the rolling roller against the work roller so as to press the metal ring, wherein the fourth driver is configured to move the rolling roller in a direction away from the work roller and the metal ring;

wherein the work roller and the rolling roller are driven by the first and third drivers to rotate synchronously with each other.

16. The manufacturing apparatus of an endless metal belt according to claim 15, wherein by using the means for performing a first circumference correction on the metal belt and a second circumference correction before and after the solution heat treatment, to perform a first circumference correction before the solution heat treatment and a second circumference correction after the solution heat treatment, an expansion quantity for setting a circumference of each of the metal rings to become a predetermined length is attained.

* * * * *